US005434653A

United States Patent [19]

Takizawa et al.

[11] Patent Number: 5,434,653

[45] Date of Patent: Jul. 18, 1995

[54] DEVELOPING ROLLER AND APPARATUS

[75] Inventors: Yoshio Takizawa, Fussa; Koji Takagi, Kodaira; Hiroshi Harashima, Kodaira; Hiroshi Kaneda, Kodaira; Hideyuki Niwa, Sayama; Taro Miyamoto; Gaku Yakushiji, both of Kodaira; Takahiro Kawagoe, Tokorozawa, all of Japan

[73] Assignee: Bridgestone Corporation, Tokyo, Japan

[21] Appl. No.: 219,357

[22] Filed: Mar. 29, 1994

[30] Foreign Application Priority Data

| | | | |
|---|---|---|---|
| Mar. 29, 1993 | [JP] | Japan | 5-093639 |
| Oct. 18, 1993 | [JP] | Japan | 5-284022 |
| Feb. 4, 1994 | [JP] | Japan | 6-033037 |
| Feb. 4, 1994 | [JP] | Japan | 6-033038 |
| Feb. 9, 1994 | [JP] | Japan | 6-036522 |

[51] Int. Cl.[6] ..... G03G 13/16

[52] U.S. Cl. ..... 355/259; 118/661; 492/59

[58] Field of Search ..... 355/259, 261; 118/651, 118/661; 492/25, 53, 56, 59

[56] References Cited

U.S. PATENT DOCUMENTS

| | | | |
|---|---|---|---|
| 4,827,868 | 5/1989 | Tarumi et al. | 355/259 X |
| 4,930,438 | 6/1990 | Demizu et al. | 118/651 |
| 4,967,231 | 10/1990 | Hosoya et al. | 355/259 X |
| 4,990,963 | 2/1991 | Yamamoto et al. | 355/259 |
| 4,994,319 | 2/1991 | Nojima et al. | 355/259 X |
| 5,168,312 | 12/1992 | Aoto et al. | 355/259 |

FOREIGN PATENT DOCUMENTS 4134468 5/1992 Japan .

*Primary Examiner*—Robert Beatty

*Attorney, Agent, or Firm*—Sughrue, Mion, Zinn, Macpeak & Seas

[57] ABSTRACT

A developing roller includes a metal shaft and a conductive resilient sleeve surrounding the shaft and made of a urethane elastomer containing carbon black with at least pH 5. The developing roller is mounted in an electrophotographic apparatus in combination with a latent image-bearing photoreceptor wherein development is carried out using a non-magnetic single-component toner.

19 Claims, 1 Drawing Sheet

DEVELOPING ROLLER AND APPARATUS

BACKGROUND OF THE INVENTION

1.Field of the Invention

This invention relates to a developing roller for use in electrophotographic apparatus such as copying machines and printers and electrostatic recording apparatus for visualizing electrostatic latent images with a non-magnetic single-component developer as well as a developing apparatus using the same. More particularly, it relates to a developing roller which is least contaminative and ensures production of satisfactory images over a long period of use as well as a developing apparatus using the same.

2. Prior Art

In conjunction with electrophotographic apparatus such as copying machines and printers and electrostatic recording apparatus, one known developing process involving supplying a non-magnetic single-component developer to a photoreceptor having a latent image borne thereon to apply the developer to the latent image for visualizing the latent image is an impression developing process as disclosed in Schaffert, U.S. Pat. No. 3,152,012 and Bettiga et al., U.S. Pat. No. 3,731,146. Since this process eliminates a need for magnetic material, the apparatus can be readily simplified in structure, reduced in size, and modified to be compatible with color toners.

The impression developing process performs development by bringing a developing roller carrying a non-magnetic single-component developer or toner in contact with a latent image bearing member having a latent image borne thereon, typically a photoreceptor whereby the toner is transferred to the latent image on the latent image bearing member. Thus the developing roller must be made of a resilient material having conductivity.

Referring to FIG. 2, the impression developing process is described in detail. Between a toner applicator roller 4 for supplying a toner 6 and a photoreceptor 5 having a latent image borne thereon is disposed a developing roller 1 in close contact with the photoreceptor 5, but slightly spaced from the toner applicator roller 4. The developing roller 1, photoreceptor 5 and toner applicator roller 4 rotate in directions shown by arrows. The toner applicator roller 4 supplies the toner 6 to the surface of the developing roller 1 whereupon the toner 6 is leveled into a uniform layer by means of a distributing blade 7. As the developing roller 1 rotates in contact with the photoreceptor 5 in this state, the toner in a thin layer form is transferred from the developing roller 1 to the latent image on the photoreceptor 5 for visualizing the latent image. Also illustrated in FIG. 2 are a transfer section 8 for transferring the toner image from the member 5 to a recording medium such as a sheet of paper, and a cleaning section 9 including a cleaning blade 10 for removing the toner remaining on the surface of the photoreceptor 5 after transfer.

During rotation, the developing roller 1 must be kept in close contact with the photoreceptor 5. Then the developing roller 1 is of a structure shown in FIG. 1 as comprising a shaft 2 of a highly conductive material such as metal and a resilient sleeve 3 surrounding the shaft 2. The resilient sleeve 3 is made of a resilient material composed of an elastic rubber such as silicone rubber and NBR and a sponge material such as polyurethane foam and a conductive agent blended therein for imparting conductivity.

The prior art developing rollers have several drawbacks. The following two drawbacks are attributable to the resilient sleeve.

(1) Where the resilient sleeve is made of an elastic rubber such as silicone rubber and NBR, the rubber is reduced in hardness in order to ensure close contact, with the risk of contaminating the photoreceptor.

(2) Where the resilient sleeve is made of a sponge material such as polyurethane foam, the toner can penetrate into the resilient sleeve. Then over a long period of use, the developing roller becomes harder due to toner clogging and the toner experiences short charging, resulting in images of poor quality.

In general, the developing rollers having a single-layer resilient sleeve have (3) problems including an unsatisfactory rise of charging of the toner on the roller, fog in images due to toner short charging, poor cleaning due to selective development, a lowering of printing density, and a substantial lowering of printing quality after long-term continuous printing. These phenomena become more outstanding in a hot humid environment.

(4) If the resilient sleeve is less resistant against abrasion, the surface of the resilient sleeve is scraped and roughened by the distributing blade 7 (in FIG. 2). It is then difficult to provide a constant supply of toner onto the photoreceptor 5 (in FIG. 2) over a long term.

(5) The resilient sleeve can be deteriorated by ozone generating in copying machines and printers, giving rise to such inconvenience as cracks and increased compression set in the resilient sleeve. It is then difficult to provide a constant supply of toner onto the photoreceptor 5 (in FIG. 2) over a long term.

It was also proposed to form at least one conductive resin layer outside the resilient sleeve as disclosed in Japanese Patent Application Kokai (JP-A) No. 134468/1992. The developing roller having a conductive resin layer on the resilient sleeve suffers from the problems that the manufacturing process is complex because of a multi-layer structure, failing to provide a low cost developing roller and apparatus and that it is difficult to maintain the resistance of the conductive resin layer stable over a long period of time.

SUMMARY OF THE INVENTION

Therefore, an object of the present invention is to provide a developing roller which has a sufficiently low hardness to ensure good close contact, does not give rise to inconvenience like contamination of a photoreceptor, can produce images of high definition free of density irregularity and background fog, and undergoes no deterioration of image quality over a long term of use.

Another object of the present invention is to provide a developing roller which can produce an image of constant quality under a hot humid environment without inconvenience such as fog, has sufficient abrasion resistance to avoid deterioration by friction with a blade and the like and ozone resistance, and can be manufactured through simple steps at a low cost.

A further object of the present invention is to provide a developing apparatus using the developing roller.

A developing roller comprising a highly conductive shaft and a conductive resilient sleeve surrounding the shaft is used by having the developing roller carrying a non-magnetic single-component developer to form a thin layer of the developer on the surface and contact a latent image-bearing member having an electrostatic latent image borne on the surface thereof, typically a photoreceptor for adhering the developer to the latent image on the bearing member surface for developing the latent image. We have found that when the resilient sleeve is made of a urethane elastomer containing carbon black with pH 5 or higher, especially when the urethane elastomer is adjusted to have a resistivity of $10^4$ to $10^{10}$ Ωcm, a hardness of up to 55° on JIS A scale, and a surface roughness Rz of up to 10 μm as expressed in JIS ten point average roughness, the resulting developing roller ensures close contact with the latent image-bearing member, does not cause inconvenience such as contamination of the latent image-bearing member, assists in producing images of high definition free of density variation and background fog and without image quality deterioration over a long period of use. When silicone powder is further blended in the urethane elastomer to form the resilient sleeve of the developing roller, all the above-mentioned advantages are maintained even in a hot humid environment.

We have also found that by treating the developing roller on the surface with a coupling agent, contamination of a member to be contacted with the developing roller, typically photoreceptor is minimized. The treatment with a coupling agent does cause no inconvenience to the developing roller and allows the developing roller to exert its performance to a full extent.

We have further found that by treating a resin solution containing alcohol-soluble nylon, acrylic resin, acryl-modified urethane resin or polycarbonate and having a resin concentration of 3% by weight or less on the surface of the resilient sleeve by immersing the resilient sleeve into the resin solution, contamination of the latent image-bearing member, typically photoreceptor is effectively suppressed.

The photoreceptor is often contaminated when no developer is present between the developing roller surface and the photoreceptor surface, that is, in an initial state prior to use. The resin solution surface treatment is effective for restraining such contamination. Particularly when the resilient sleeve is surface treated with the alcohol-soluble nylon, acrylic resin, acryl-modified urethane resin or polycarbonate solution, it is effective for blocking migration of contaminants from the resilient sleeve. Since the resin solution treatment has no significant effect on the electric charge of the developer on the roller surface, the developing roller ensures production of images of high definition free of density variation and background fog and without a lowering of image quality over a long period of use.

Accordingly, the present invention pertains to a developing roller comprising a highly conductive shaft and a conductive resilient sleeve surrounding the shaft, the developing roller carrying a non-magnetic single-component developer on the surface of the resilient sleeve to form a thin layer of the developer and being contacted with a latent image bearing member having an electrostatic latent image borne on the surface thereof, whereby the developer is transferred from the thin layer to the latent image on the bearing member surface for visualizing the latent image.

In the present invention, the resilient sleeve is made of a urethane elastomer containing carbon black with pH 5 or higher. In one preferred embodiment, the urethane elastomer has a resistivity of $10^4$ to $10^{10}$ Ωcm, a hardness of up to 55° on JIS A scale, and a surface roughness Rz of up to 10 μm as expressed in JIS ten point average roughness. Also preferably, the urethane elastomer further contains silicone powder.

In a preferred embodiment, the resilient sleeve on the surface is treated with a coupling agent, or treated with a resin solution having a resin concentration of 3% by weight or less by immersing the resilient sleeve into the resin solution.

Also contemplated herein is a developing apparatus comprising a rotating roller or drum-shaped member having an electrostatic latent image borne on the surface thereof, and a developing roller carrying a non-magnetic single-component developer on the outer peripheral surface thereof, the developing roller being contacted with the latent image bearing member, the developer is transferred from the developing roller to the latent image on the surface of the latent image bearing member for visualizing the latent image, wherein the developing roller is the above-mentioned developing roller.

DETAILED DESCRIPTION OF THE INVENTION

Figure 1:
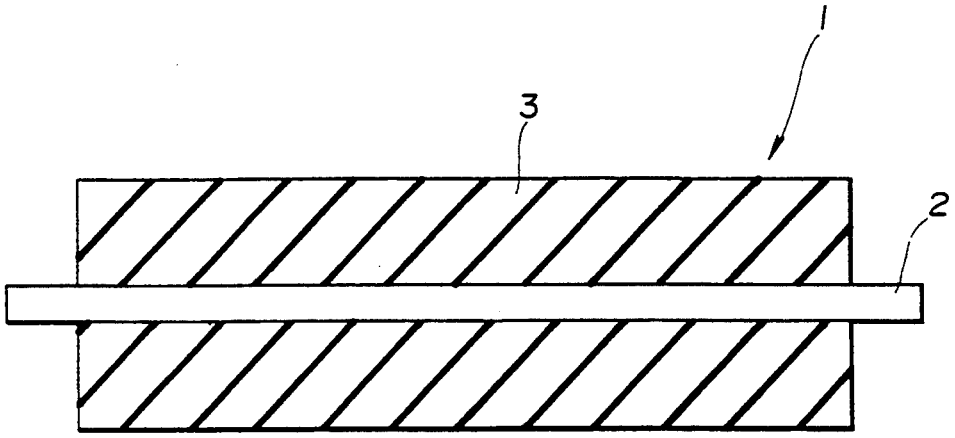
FIG. 1 is a schematic axial cross section of one exemplary developing roller according to the present invention.

The developing roller of the present invention is schematically shown in FIG. 1 as comprising a highly conductive shaft 2 and a conductive resilient sleeve 3 surrounding the shaft 2.

The shaft may be made of any material insofar as it is highly conductive. Most often, a metallic shaft is used. It may be either a solid metal mandrel or a hollow metal cylinder.

The resilient sleeve 3 is formed on the outer periphery of the shaft 2. According to the present invention, the resilient sleeve is made of a urethane elastomer containing carbon black with at least pH 5. The urethane elastomer used herein may be prepared by any desired one of conventional methods, for example, by blending carbon black in polyurethane prepolymer followed by crosslinking curing of the prepolymer, or by blending a carbon black in a polyol and reacting the polyol with a polyisocyanate by a one-shot process. Thermoplastic polyurethanes are also used.

The polyol used in the preparation of polyurethane may be a polyether polyol, a polyester polyol, a polyolefin polyol or a mixture thereof. Exemplary polyether polyols include polyethylene glycol, polypropylene glycol and polytetramethylene glycol. Exemplary polyester polyols include condensation type polyester polyols which are obtained from (1) alcohol components including glycols, for example, aliphatic glycols (e.g., ethylene glycol, propylene glycol, butylene glycol, pentene glycol, and hexene glycol) and polyalkylene glycols (e.g., diethylene glycol and dipropylene glycol) and tri-or polyhydric alcohols (e.g., trimethylol propane), and (2) polybasic acid components, for example, aliphatic dicarboxylic acids (e.g., adipic acid, sebacic acid, suberic acid, brassylic acid, and succinic acid) and aromatic dicarboxylic acids (e.g., terephthalic acid and isophthalic acid). Exemplary polyolefin polyols include polybutadiene polyol, and polyisoprene polyol.

Especially, an urethane elastomer prepared by curing a composition in which a polyolefin polyol is used as a polyol is preferred.

The polyisocyanate used in the preparation of polyurethane is not particularly limited. Preferred are those polyisocyanates having folded molecular structure, especially polyisocyanates of the following general formula:

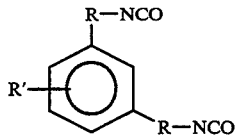

wherein R is a valence bond or an alkylene group and R' is hydrogen or an alkyl group. The polyisocyanates are advantageous in that they prevent crystallization of polyurethane chains so that the polyurethane may be reduced in hardness and that they facilitate entanglement of molecular chains to create a pseudo-crosslinked structure so that the polyurethane may be smoothly released from the mold.

Examples of the polyisocyanate include 2,4-tolylene diisocyanate, 2,6-tolylene diisocyanate, a mixture thereof, m-tetramethylxylylene diisocyanate, m-xylylene diisocyanate, m-phenylene diisocyanate, and diphenylmethane-4,4'-diisocyanate. Among them, diphenylmethane-4,4'-diisocyanate is most preferred.

Especially, an urethane elastomer prepared by curing a composition in which a modified diphenylmethane-4,4'-diisocyanate containing an uretonimine-modified diphenylmethane-4,4'-diisocyanate preferably in an amount of 5 to 50% by weight is used as an isocyanate is preferred. The use of a crude diphenylmethane -4,4'-diisocyanate is also preferred.

The developing roller according to the present invention is prepared by blending carbon black in the above-mentioned urethane elastomer to impart electric conductivity, and forming the resilient sleeve from this conductive urethane elastomer. The carbon black used herein has pH 5 or higher. It is known that carbon black tends to be triboelectrically charged positive with higher pH values and negative with lower pH values. Since the developing roller of the invention is designed to carry a non-magnetic single-component developer or toner which is charged negative, the pH of carbon black used herein is set at 5 or higher. In practice, when a non-magnetic single-component negative chargeable toner was used, more toner of opposite polarity built up on a developing roller having carbon black with a pH of lower than 5 blended therein, resulting in toner scattering.

The carbon black used in the developing roller of the invention may be any of acetylene black, Ketjen Black and furnace black insofar as it has pH 5 or higher, with furnace black at pH 6 or higher being preferred.

The pH of carbon black varies with the number of functional groups, especially carboxyl groups available on the carbon black surface and is an index indicating whether it is acidic or basic. In general, oxygen-containing functional groups such as phenolic hydroxyl groups, carboxyl groups and quinone type oxygen are present on the surface of carbon black, and the number of surface functional groups depends on the type of carbon black. Carbon black varies in surface nature with its preparation method. Many functional groups are present on the surface of channel black whereas less functional groups are available on the surface of furnace black and acetylene black. The pH of carbon black is measured, for example, by weighing about 5 grams of carbon black, mixing it with 150 cc of distilled water, boiling the water for 5 minutes, allowing the water to cool down to room temperature, effecting centrifugal separation by a centrifuge at 2,000 rpm, removing the supernatant, separating the sludge, admitting it in a beaker as a sample, and measuring pH by a pH meter.

By the blending of carbon black in urethane elastomer, the resilient sleeve is preferably adjusted to a resistivity of $10^4$ to $10^{10}$ Ωcm, especially $10^6$ to $10^9$ Ωcm though the invention is not limited thereto. With a resistivity of less than $10^4$ Ωcm, electric charges would leak to the photoreceptor and the developing roller itself can be broken by the applied voltage. A sleeve with a resistivity higher than $10^{10}$ Ωcm is likely to cause background fog. The resistivity of the resilient sleeve may be controlled by blending another conductive additive such as metal powder and metal oxides along with carbon black. Although the proportion of carbon black blended in the urethane elastomer is not particularly limited, it is preferably blended in an amount to provide the resilient sleeve with a resistivity within the preferred range. Illustratively, about 0.5 to 50 parts, especially about 1 to 30 parts by weight of carbon black is preferably blended with 100 parts by weight of the urethane elastomer. The resistance control may be conducted by blending an ion conductive material such as sodium perchlorate and tetraethyl ammonium chloride.

In the developing roller including a resilient sleeve made mainly of the urethane elastomer according to the present invention, the resilient sleeve preferably has a hardness of up to 55°, more preferably 25° to 45° on JIS A scale. A resilient sleeve having a hardness of more than 55° would have a reduced area of contact with the photoreceptor, failing to achieve satisfactory development. Inversely, a too low hardness is accompanied by a greater compression set, and a variation of image density can occur when the developing roller is deformed or offset for some reason or other. Then even when the resilient sleeve has a low hardness, its compression set should preferably be as low as possible, more preferably up to 20%.

The developing roller of the present invention, more particularly, its resilient sleeve should preferably have a surface roughness Rz of up to 10 μm, more preferably 1 to 8 μm as expressed in JIS ten point average roughness. With Rz>10 μm, a layer of the non-magnetic single-component developer or toner on the roller surface would lose uniformity in thickness and electric charge. A Rz of less than 10 μm is effective for improving the adherence of the toner to the roller surface and preventing deterioration of image quality due to roller abrasion over a long period of use. The compression set is preferably in the range of 20% or less.

In one preferred embodiment of the developing roller, silicone powder is added to the urethane elastomer of which the resilient sleeve is made. Addition of silicone powder is effective for preventing a lowering of performance in a hot humid environment, especially for suppressing occurrence of fog in a hot humid environment.

Since urethane elastomers are generally hygroscopic, they tend to reduce their ability to electrically charge the toner on the roller surface at high temperature and high humidity. As a result, the toner layer on the roller surface contains a more proportion of weakly charged toner, causing fog. On the other hand, silicone powder is water repellent. Dispersion of such silicone powder in an urethane elastomer is effective for hindering moisture absorption on the roller surface. Then when the resilient sleeve is made of a composition comprising an urethane elastomer, carbon black, and silicone powder, the developing roller maintains its ability to electrically charge the toner even at high temperature and high humidity without contaminating the latent image-bearing member and thus ensures production of a fog-free clear image even at high temperature and high humidity.

The silicone powder used herein may be selected from finely divided silicone resins, finely divided silicone rubber and silicone oil carried on an inorganic support. Preferred are silicone particles which are adjusted to a particle size of about 0.1 to about 20 μm, especially about 0.5 to about 5 μm by comminution or polymerization. Silicone particles with a size of more than 20 μm would adversely affect the smoothness of the roller surface and the uniformity of toner charge, causing a loss of image quality.

Though not critical, the amount of silicone powder blended is preferably about 0.1 to about 30 parts, more preferably about 1 to about 10 parts by weight per 100 parts by weight of the urethane elastomer.

To the urethane elastomer of which the resilient sleeve is made, a suitable charge control agent may be added for the purpose of controlling the electric charge of the toner on the surface of the developing roller. The charge control agent used herein may be selected from conventional dyestuffs and pigments used for toner charge controlling purpose, for example, Nigrosine, triaminotriphenylmethane dyestuffs, cationic dyestuffs, dioxazines, azo pigments, azo-chrome complexes and quinacridones. Preferably about 0.1 to about 20 parts, more preferably about 1 to about 5 parts by weight of the charge control agent is blended per 100 parts by weight of the urethane elastomer.

In the present invention, it is recommended that the resilient sleeve of the developing roller is treated with a coupling agent. The coupling agent (inclusive of the meaning of a primer) used for surface treatment may be any of silane, phosphorus, titanate and aluminum systems insofar as it has high affinity to the base material, that is, polyurethane. The afficinity to the base material is generally maintained by a hydroxyl group that the coupling agent possesses or that is generated at the molecular end of the coupling agent through hydrolysis or the like. Where the base material is a polyurethane, a coupling agent having an isocyanate group as a reactive functional group may also be used. Especially a coupling agent having two or more reactive functional groups is effective for treating the roller surface uniformly by virtue of chain extension through self-reaction of the coupling agent. Further preferred for use in surface treatment is a coupling agent having a more reactive functional group, for example, vinyltrimethoxysilane and vinyltriethoxysilane.

No particular limit is imposed on the treating process. Preferred are wet treating processes of dipping in or spraying a solution containing a coupling agent in a concentration of about 0.1 to 20% by weight, more preferably about 0.5 to 10% by weight. Use of a too high concentration solution is less desirable because it would form a coupling agent layer of several molecule thickness on the surface of the base material (polyurethene) and due to a weak bond to the base material, that coupling agent would migrate to the photoreceptor to cause contamination. In this regard, wet treatment may be followed by heat treatment in order to enhance the bond between the coupling agent and the base material. This heat treatment is preferably carried out at a temperature of about 50° to 150° C., especially about 80° to 120° C. for about 30 to 150 minutes, especially about 60 to 120 minutes.

The coupling treatment is effective for minimizing contamination of a latent image-bearing member or photoreceptor to be contacted with the developing roller. The mechanism that surface treatment with the coupling agent prevents contamination to the photoreceptor is not well understood. Where the base material is polyurethane, unreacted polyol which is regarded as one of contaminants will be fixed to the base material through reaction of a hydroxyl group thereof with the coupling agent whereby bleeding of the polyol to the photoreceptor is prevented.

Low molecular weight substances which are regarded as contaminants in polyurethane are also prevented from bleeding by the steric hindrance of the coupling agent present on the surface.

Instead of the coupling treatment, it is also recommended to treat with a resin solution the resilient sleeve of the developing roller according to the present invention. The resin solution is preferably made of alcohol-soluble nylon, acrylic resin, acryl-modified urethane resin or polycarbonate.

Exemplary alcohol-soluble nylons include copolymerized nylons such as 6/66/12, 6/66/610/12, and 6/610/11/12 nylons and N-alkoxymethylated nylons such as N-methoxy-methylated nylons and N-ethoxyethylated nylons. Exemplary acryl-modified urethane resins include those obtained by reacting a hydroxy group-introduced acryl polymer and an urethane prepolymer having isocyanate groups at both ends of the molecule. Exemplary polycarbonates include bisphenol A type polycarbonates, bisphenol Z type polycarbonates and substituents thereof. Exemplary acrylic resins include polyacrylates, polymethacrylates and polymethyethacrylates. Among them, alcohol-soluble nylons are preferred.

The resin solution treatment should be conducted by immersing the resilient roller into a resin solution having a resin concentration of 3% by weight or less. The solvent for the resin solution is any one which can dissolve the resin at a concentration of 3% by weight or less.

The resin solution treatment would not substantially change the Rz of the roller surface because the amount of the resin on the developing roller surface is not sufficient for forming a complete layer.

The developing roller of the present invention can be incorporated in a conventional developing apparatus using a non-magnetic single-component developer or toner. Reference is made to FIG. 2 again. Between a toner applicator roller 4 for supplying a toner 6 and a photoreceptor 5 having a latent image borne thereon is disposed a developing roller 1 in close contact with the photoreceptor 5. The developing roller 1, photoreceptor 5 and toner applicator roller 4 rotate in directions shown by arrows. The toner applicator roller 4 supplies the toner 6 to the surface of the developing roller 1 whereupon the toner 6 is leveled into a uniform layer by means of a distributing blade 7. As the developing roller 1 rotates in contact with the photoreceptor 5 in this state, the toner in a thin layer form is impressed to the latent image on the photoreceptor 5 for visualizing the latent image. The toner image is thereafter transferred from the drum 5 to a sheet of paper in a transfer section 8.

EXAMPLE

Examples of the present invention are given below by way of illustration and not by way of limitation. All parts are by weight. Rz is a JIS ten point average roughness.

Example 1

A polyol composition was prepared by adding 1.0 part of 1,4-butane diol, 1.5 parts of a silicone surfactant (L-520 manufactured by Nippon Unicar K.K.), 0.5 parts of acetyl-acetonatonickel, 0.01 part of dibutyltin dilaurate, and 1.0 part of acetylene black (manufactured by Denka K.K., pH 6.9) to 100 parts of a polyether polyol resulting from addition reaction of propylene oxide and ethylene oxide to glycerin and having a molecular weight of 5,000 and a OH value of 33 (Excenol 828, manufactured by Asahi Glass K.K.), premixing the components in a mixer, and milling the mixture in a paint roll mill until the acetylene black was uniformly dispersed.

The polyol composition was agitated under vacuum for deaeration, combined with 17.5 parts of urethane-modified diphenylmethane-4,4'-diisocyanate (Sumidur PF, manufactured by Sumitomo Bayer Urethane K.K.), and agitated for 2 minutes. The resulting composition was cast into a mold cavity (a metallic shaft extended therethrough) at 110° C. and cured for 2 hours. There was obtained a roller of the structure shown in FIG. 1 having a resilient sleeve formed around the metallic shaft. The roller was buffed on the surface to a surface roughness Rz of 7 μm. This is designated developing roller A.

A developing roller B was manufactured by the same procedure as above except that 1 part of silicone powder having a particle size 3 μm (Torefil E-500, manufactured by Toray Silicone K.K.) was added to the polyol composition.

Example 2

Developing rollers A (silicone powder free) and B (silicone powder blended) were manufactured by the same procedure as in Example 1 except that 1,4-butane diol was omitted and the amount of Sumidur PF added was 12.5 parts.

Example 3

To 100 parts of polyisoprene polyol having a molecular weight of 2500 and a OH value of 47.1 were added 3.32 parts of acetylene black and the mixture was agitated for 30 minutes. Thereafter, 13.33 parts of crude MD1 (NCO%=31.7) and 0.001 part of dibutyltin dilaurate were added to the mixture to agitate for 3 minutes. Then the resulting mixture was poured into a mold in which a metallic shaft was provided and cured at 90° C. for 12 hours to prepare a roller having a resilient sleeve formed around the metallic shaft.

From the thus obtained roller, a developing roller A (silicone powder free) and a developing roller B (silicone powder blended) were manufactured by the same procedure as in Example 1.

Example 4

A developing roller A (silicone powder free) and a developing roller B (silicone powder blended) were manufactured in the same manner as in Example 3 except that 13.47 parts of a modified MDI (NCO% =29.0) containing 30% by weight of uretonimine-modified MDI.

Example 5

A developing roller A (silicone powder free) was manufactured by the same procedure as in Example 1 except that 1 part of Ketjen EC Black (manufactured by Lion K.K., pH 9.0) was added instead of acetylene black.

Example 6

A developing roller B (silicone powder blended) was manufactured by the same procedure as in Example 1 except that instead of Torefil E-500, 1 part of Tospearl 108 having a particle size 0.8 μm (manufactured by Toshiba Silicone K.K.) was added as the silicone powder.

Example 7

A prepolymer was prepared by adding 25 parts of Sumidur PF (urethane-modified diphenylmethane-4,4'-diisocyanate, Sumitomo Bayer Urethane K.K.) to 100 parts of Excenol 828 (polyether polyol, Asahi Glass K.K.) and reacting them at 60° C. for 3 minutes. To the prepolymer were added 2 parts of Ketjen EC Black (Lion K.K., pH 9.0) and 100 parts of Excenol 828. These components were agitated and milled, obtaining a polyol composition. Thereafter, following the procedure of Example 1, a developing roller A (silicone powder free) was manufactured.

A developing roller B (silicone powder blended) was manufactured by the same procedure as above except that 1 part of Torefil E-500 silicone powder was added to the polyol composition.

Example 8

Developing rollers A (silicone powder free) and B (silicone powder blended) were manufactured by the same procedure as in Example 1 except that 15 parts of Furnace Black HAF (manufactured by Mitsubishi Chemicals K.K., pH 7.5) was added instead of acetylene black.

Example 9

Developing rollers A (silicone powder free) and B (silicone powder blended) were manufactured by the same procedure as in Example 1 except that 3 parts of Nigrosine charge control agent (Bontron N-04, manufactured by Orient Chemical Industry K.K.) was further added to the polyol composition.

Example 10

Developing rollers A (silicone powder free) and B (silicone powder blended) were manufactured by the same procedure as in Example 1 except that 3 parts of a triaminophenylmethane charge control agent (Copy Blue PR, manufactured by Hoechst Japan K.K.) was further added to the polyol composition.

Comparative Example 1

Developing rollers A (silicone powder free) and B (silicone powder blended) were manufactured by the same procedure as in Example 1 except that 30 parts of carbon black PRINTEX-U (pH 4.0, manufactured by DeGussa AG) was added instead of acetylene black.

Comparative Example 2

Developing rollers A (silicone powder free) and B (silicone powder blended) were manufactured by the same procedure as in Example 1 except that the amount of 1,4-butane diol added was 3 parts, the amount of Sumidur PF added was 27.5 parts, and 30 parts of carbon black PRINTEX-U (pH 4.0) was added instead of acetylene black.

Comparative Example 3

Developing rollers A (silicone powder free) and B (silicone powder blended) were manufactured by the same procedure as in Example 1 except that 15 parts of natural graphite AOP (pH 6.3, manufactured by Nippon Graphite K.K.) was added instead of acetylene black.

Comparative Example 4

Developing rollers A (silicone powder free) and B (silicone powder blended) were manufactured by the same procedure as in Example 1 except that 30 parts of carbon black PRINTEX-U (pH 4.0) was added instead of acetylene black and surface polishing was done to a surface roughness Rz of 13 μm.

Comparative Example 5

A developing roller A (silicone powder free) was manufactured by the same procedure as in Example 1 except that 8.3 parts of tolylene diisocyanate was added instead of the urethane-modified diisocyanate.

The developing rollers of Examples 1–10 and Comparative Examples 1–5 were examined by the following tests. The results are shown in Table 1.

(1) Electric resistivity

Sheet samples were prepared under the same conditions as the rollers and measured for resistivity by means of a resistance meter Hiresta (manufactured by Mitsubishi Petro-Chemical K.K.) with a voltage of 100V applied.

(2) Hardness and Compression set

Sheet samples were prepared under the same conditions as the rollers and measured for hardness and compression set according to JIS K-6301. Hardness was on A scale.

(3) Surface roughness (Rz)

The rollers were measured for surface roughness by means of a surface roughness meter model Handy Surf E-30A (manufactured by Tokyo Seimitsu K.K.).

(4) Contamination of photoreceptor

Each roller was forced in close contact with a photoreceptor for a printer SP-3 (manufactured by Ricoh K.K.) under a load of 1 kg and maintained in contact at 30° C. and RH 85% for 72 hours. The photoreceptor on the surface was visually inspected for contamination.

(5) Toner charge quantity

Figure 2:
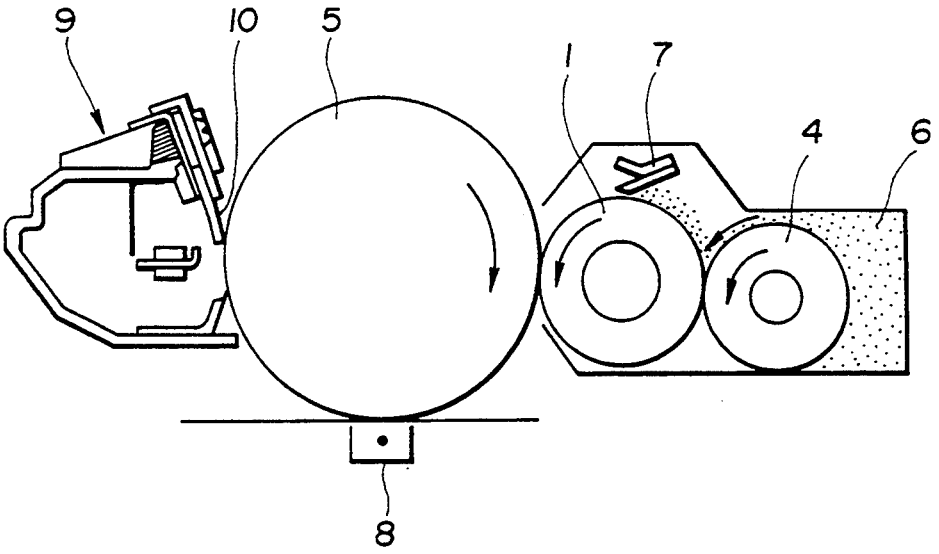
FIG. 2 is a schematic cross section of one exemplary developing apparatus according to the present invention.

Each developing roller was mounted in the developing unit shown in FIG. 2. It was rotated at a circumferential speed of 50 mm/sec. to form a uniform thin layer of the toner on its surface. This toner layer was pneumatically sucked into a Faraday gage for measuring the charge quantity.

(6) Image print

Each developing roller was mounted in the developing unit shown in FIG. 2. While it was rotated at a circumferential speed of 60 mm/sec., reversal development was carried out to print images on sheets of paper. The images of the initial and 2,000th prints were evaluated for fog and toner scatter. Also at the end of 2,000th print, the roller surface was observed for toner filming.

TABLE 1

| | | Roller *1 | Resistivity (Ω cm) | Hardness (°) | Compression set (%) | Rz (μm) | Toner charge quantity *2 (μc/g) | Contamination | Image quality *3 (fog, scatter) | Toner filming on roller |
|---|---|---|---|---|---|---|---|---|---|---|
| Example | 1 | A | $2 \times 10^9$ | 45 | 5 | 7 | −8.0 | none | good | none |
| | | | | | | | −4.5 | | fog | |
| | | B | $2 \times 10^9$ | 45 | 5 | 7 | −12.0 | none | good | none |
| | | | | | | | −10.5 | | good | |
| | 2 | A | $2 \times 10^9$ | 4 | 10 | 7 | −8.0 | none | good | none |
| | | B | $2 \times 10^9$ | 40 | 10 | 7 | −11.5 | none | good | none |
| | | | | | | | −10.5 | | good | |
| | 3 | A | $2 \times 10^7$ | 45 | 5 | 7 | −7.5 | none | good | none |
| | | | | | | | −4.5 | | good | |
| | | B | $2 \times 10^7$ | 45 | 5 | 7 | −11.0 | none | good | none |
| | | | | | | | −9.5 | | good | |
| | 4 | A | $2 \times 10^8$ | 45 | 5 | 7 | −8.5 | none | good | none |
| | | | | | | | −4.0 | | good | |
| | | B | $2 \times 10^8$ | 45 | 5 | 7 | −11.5 | none | good | none |
| | | | | | | | −9.0 | | good | |
| | 5 | A | $4 \times 10^8$ | 45 | 5 | 7 | −9.5 | none | good | none |
| | 6 | B | $8 \times 10^8$ | 45 | 5 | 7 | −13.5 | none | good | none |
| | | | | | | | −11.0 | | good | |
| | 7 | A | $5 \times 10^8$ | 40 | 8 | 7 | −9.0 | none | good | none |
| | | B | $5 \times 10^8$ | 40 | 8 | 7 | −11.5 | none | good | none |
| | | | | | | | −10.0 | | good | |
| | 8 | A | $1 \times 10^9$ | 45 | 5 | 7 | −15.0 | none | good | none |
| | | | | | | | −11.0 | | good | |
| | | B | $5 \times 10^8$ | 45 | 5 | 7 | −17.0 | none | good | none |
| | | | | | | | −15.0 | | good | |
| | 9 | A | $5 \times 10^8$ | 45 | 5 | 7 | −13.5 | none | good | none |
| | | | | | | | −9.0 | | good | |
| | | B | $5 \times 10^8$ | 45 | 5 | 7 | −17.0 | none | good | none |
| | | | | | | | −15.0 | | good | |
| | 10 | A | $4 \times 10^8$ | 45 | 5 | 7 | −13.0 | none | good | none |
| | | | | | | | −9.0 | | good | |

TABLE 1-continued

| | | | | | | | | | | |
|---|---|---|---|---|---|---|---|---|---|---|
| | | B | $4 \times 10^8$ | 45 | 5 | 7 | −15.5<br>−12.5 | none | good<br>good | none |
| Comparative Example | 1 | A | $5 \times 10^9$ | 45 | 5 | 7 | −2.5 | none | scatter fog | none |
| | | B | $5 \times 10^9$ | 45 | 5 | 7 | −5.0<br>−2.0 | none | fog,<br>fog,<br>scatter | none |
| | 2 | A | $2 \times 10^9$ | 60 | 3 | 7 | −8.5 | none | u.d. | none |
| | | B | $5 \times 10^8$ | 60 | 3 | 7 | −11.5<br>−10.0 | none | u.d.<br>u.d. | none |
| | 3 | A | $5 \times 10^{11}$ | 45 | 5 | 7 | −8.5 | none | fog | none |
| | | B | $5 \times 10^{11}$ | 45 | 5 | 7 | −12.0<br>−10.5 | none | fog<br>fog | none |
| | 4 | A | $2 \times 10^9$ | 45 | 5 | 13 | −4.5<br>−2.0 | none | scatter, fog<br>scatter, fog | yes |
| | | B | $5 \times 10^8$ | 45 | 5 | 13 | −6.5<br>−4.0 | none | fog<br>scatter, fog | yes |
| | 5 | A | $5 \times 10^8$ | 40 | 5 | 7 | −9.0<br>−5.5 | yes | good<br>good | none |

*1 Roller A is free of silicone powder, roller B has silicoe powder blended.
*2, 3 A single figure is a test at 23° C. and RH 55%. For two stage figures, the upper stage figure is a test at 23° C. and RH 55% and the lower stage figure is a test at 33° C. and RH 85%. "u.d." denotes "uneven density".

As seen from Table 1, the developing roller of the present invention is effective for producing images of high definition free of a density variation and background fog without causing inconvenience such as contamination of the photoreceptor. Image quality does not deteriorate over a long period of use. The addition of silicone powder is effective for preventing deterioration in performance in a hot humid environment. The toner charge quantity is increased by adding a charge control agent.

Example 9

A polyol composition was prepared by adding 1.0 part of 1,4-butane diol, 1.5 parts of a silicone surfactant (L-520 manufactured by Nippon Unicar K.K.), 0.5 parts of acetyl-acetonatonickel, 0.01 part of dibutyltin dilaurate, and 1.0 part of acetylene black (manufactured by Denka K.K., pH 6.9) to 100 parts of a polyether polyol resulting from addition reaction of propylene oxide and ethylene oxide to glycerin and having a molecular weight of 5,000 and a OH value of 33 (Excenol 828, manufactured by Asahi Glass K.K.), premixing the components in a mixer, and milling the mixture in a paint roll mill until the acetylene black was uniformly dispersed.

The polyol composition was agitated under vacuum for deaeration, combined with 17.5 parts of urethane-modified diphenylmethane-4,4'-diisocyanate (Sumidur PF, manufactured by Sumitomo Bayer Urethane K.K.), and agitated for 2 minutes. The resulting composition was cast into a mold cavity (a metallic shaft extended therethrough) at 110° C. and cured for 2 hours. There was obtained a roller of the structure shown in FIG. 1 having a resilient sleeve formed around the metallic shaft. The roller was buffed on the surface to a surface roughness Rz of 7 μm.

A coupling agent shown in Table 2 was diluted with ethanol to a concentration of 5% by weight. The roller was dipped in this solution for 1 minute, taken out of the solution, and heat treated at 90° C. The developing roller was surface treated with the coupling agent in this way.

The developing roller was forced in close contact with a photoreceptor for a printer PC1000E/4 (manufactured by NEC K.K.) under a load of 1 kg and maintained in contact at 55° C. and RH 85% for 5 days. The photoreceptor on the surface was visually inspected for contamination. The results are shown in Table 2.

The developing roller was mounted in the electrophotographic processing unit shown in FIG. 2. It was rotated at a circumferential speed of 50 mm/sec. to form a uniform thin layer of the toner on its surface. This toner layer was pneumatically sucked into a Faraday gage for measuring the charge quantity. The toner charge quantity was −8.0 μC/g, indicating that the surface treatment had no detrimental influence to toner charging.

TABLE 2

| Coupling agent | Trade name | Chemical name | Example 9 |
|---|---|---|---|
| A171 | Nippon Unicar | vinyltrimethoxy-silane | ◎ |
| A151 | Nippon Unicar | vinyltriethoxy - silane | ◎ |
| A1160 | Nippon Unicar | γ-ureidopropyl-triethoxysilane | ○ |
| A1120 | Nippon Unicar | γ-β-aminoethyl - γ-aminopropyltri-methoxysilane | ○ |
| KBE9007 | Shin - Etsu Silicone K.K. | γ-(triethoxysilyl)-isopropylisocyanate | Δ |
| KBM803 | Shin - Etsu Silicone K.K. | γ-(trimethoxysilyl)-propylmercaptane | — |
| MBS88 | Dai - Hachi Kagaku K.K. | 2-ethylhexyl-2-ethylhexylphosphonate | Δ |
| KB418 | Aginomoto K.K. | tetraisopropylbis(di - octylphosphite)titanate | Δ |

◎: no contamination
○: little contamination (fully improved as compared with no coupling treatment)
Δ: partial contamination (improved as compared with no coupling treatment)

Example 10

The developing roller A of Example 1 was dipped in a solution of 1% by weight of soluble nylon CM8000 (Toray K.K.) in methanol, taken out of the solution, and dried.

Example 11

The developing roller A of Example 1 was dipped in a solution of 3% by weight of polymethyl methacrylate (Mitsubishi Rayon K.K.) in toluene/methyl ethyl ketone, taken out of the solution, and dried.

Example 12

The developing roller A of Example 1 was dipped in a solution of 1% by weight of polycarbonate (Z200, Mitsubishi Gas Chemical K.K.) in toluene, taken out of the solution, and dried.

Example 13

The developing roller A of Example 1 was dipped in a solution of 3% by weight of acryl-modified polyurethane resin IB582 (Sanyo Chemical K.K.) in toluene/methyl ethyl ketone/isopropyl alcohol, taken out of the solution, and dried.

Comparative Example 5

The procedure of Example 10 was repeated except that a solution of 10% by weight of soluble nylon CM8000 in methanol was used.

Comparative Example 6

The procedure of Example 10 was repeated except that a solution of 2% by weight of polyvinyl chloride (Eslek E, manufactured by Sekisui Chemical K.K.) was used.

The developing rollers of Examples 10–13 and Comparative Examples 5–6 were examined by the following tests. The results are shown in Table 3.

(1) Electric resistivity

Sheet samples were prepared under the same conditions as the rollers and measured for resistivity by means of a resistance meter Hiresta (manufactured by Mitsubishi Petro-Chemical K.K.) with a voltage of 100V applied.

(2) Surface roughness (Rz)

The roller were measured for surface roughness by means of a surface roughness meter model Handy Surf E-30A (manufactured by Tokyo Seimitsu K.K.).

(3) Contamination of photoreceptor

Each roller was forced in close contact with a photoreceptor for a printer PC-PR1000E/4 (manufactured by NEC K.K.) under a load of 500 grams and maintained in contact at 55° C. and RH 85% for 72 hours. The photoreceptor on the surface was visually inspected for contamination. Also the printer with the roller mounted therein was operated to print images, which were visually observed.

(4) Toner charge quantity

Each developing roller was mounted in the developing unit shown in FIG. 2. It was rotated at a circumferential speed of 50 mm/sec. to form a uniform thin layer of the toner on its surface. This toner layer was pneumatically sucked into a Faraday gage for measuring the charge quantity.

(5) Image print

Each developing roller was mounted in the developing unit shown in FIG. 2. The unit was charged with a non-magnetic single-component toner having an average particle size of 7 μm. While the roller was rotated at a circumferential speed of 60 mm/sec., reversal development was carried out to print images on sheets of paper. The images of the initial and 2,000th prints were evaluated for, density, fog and toner scatter.

TABLE 3

| Roller | Surface resin | Resistivity (Ω cm) | Hardness (°) | Rz (μm) | Toner charge quantity (μC/g) | Contamination | Image quality |
|---|---|---|---|---|---|---|---|
| Example 10 | soluble nylon | $5 \times 10^8$ | 45 | 7 | −9.5 | none | good |
| Example 11 | acrylic polymer | $8 \times 10^8$ | 45 | 7 | −10.5 | none | good |
| Example 12 | poly-carbonate | $1 \times 10^9$ | 45 | 7 | −8.0 | none | good |
| Example 13 | acryl-modified urethane | $5 \times 10^8$ | 40 | 7 | −9.5 | none | good |
| Reference* Example | — | $5 \times 10^8$ | 45 | 7 | −9.0 | stained | good |
| Comparative Example 5 | soluble nylon (20 μm) | $7 \times 10^9$ | 48 | 7 | — | none | density lowering |
| Comparative Example 6 | polyvinyl chloride | $7 \times 10^8$ | 45 | 7 | −4.0 | none | fogging |

*no coating

As seen from Table 3, the developing roller treated with a diluted resin solution is effective for preventing contamination to the photoreceptor, maintaining a toner charge quantity, and producing images without a density lowering or fog.

Although some preferred embodiments have been described, many modifications and variations may be made thereto in the light of the above teachings. It is therefore to be understood that within the scope of the appended claims, the invention may be practiced otherwise than as specifically described.

We claim:

1. In a developing roller comprising a highly conductive shaft and a conductive resilient sleeve surrounding the shaft, said developing roller carrying a non-magnetic single-component developer on the surface of said conductive resilient sleeve to form a thin layer of the developer and being contacted with a latent image bearing member having an electrostatic latent image borne on the surface thereof, whereby said developer is transferred from said thin layer to the electrostatic latent image on the image bearing member surface for visualizing the latent image, the improvement wherein;

said conductive resilient sleeve is made of a urethane elastomer containing carbon black wherein said carbon black has a pH of at least 5.

2. A developing roller according to claim 1 wherein said urethane elastomer has a resistivity of $10^4$ to $10^{10}$ Ωcm, a hardness of up to 55° on JIS A scale, and a surface roughness Rz of up to 10 μm as expressed in JIS ten point average roughness.

3. A developing roller according to claim 1 wherein said carbon black is furnace black.

4. A developing roller according to claim 1 wherein said urethane elastomer is one prepared by using a polyolefin polyol as a polyol.

5. A developing roller according to claim 1 wherein said urethane elastomer is one prepared by using as an isocyanate a modified diphenylmethane-4-4'-diisocyanate containing an uretonimine-modified diphenylmethane-4-4'-diisocyanate.

6. A developing roller according to claim 1 wherein said urethane elastomer is one prepared by using a crude diphenylmethane-4-4'-diisocyanate.

7. A developing roller according to claim 1 wherein said urethane elastomer further contains silicone powder.

8. A developing roller according to claim 1 wherein said urethane elastomer further contains a charge control agent.

9. A developing roller according to claim 1 wherein said resilient sleeve on the surface is treated with a coupling agent.

10. A developing roller according to claim 9 wherein the coupling agent is one having two or more reactive functional groups.

11. A developing roller according to claim 9 wherein the treatment with the coupling agent is conducted by a wet treating process using a solution containing the coupling agent in a concentration of 0.5 to 10% by weight.

12. A developing roller according to claim 9 wherein the coupling agent is a silane coupling agent.

13. A developing roller according to claim 1 wherein said resilient sleeve is surface treated with a resin solution having a resin concentration of 3% by weight or less by immersing said resilient sleeve into said resin solution, said resin being selected from the group consisting of alcohol-soluble nylons, acrylic resins, acryl-modified urethane resins and polycarbonates.

14. An image forming apparatus comprising:

a latent image bearing member and a developing roller; wherein, in said developing roller comprising a highly conductive shaft and a conductive resilient sleeve surrounding the shaft, said developing roller carrying a non-magnetic single-component developer on the surface of said conductive resilient sleeve to form a thin layer of the developer and being contacted with said latent image bearing member having an electrostatic latent image borne on the surface thereof, whereby said developer is transferred from said thin layer to said electrostatic latent image on the image bearing member surface for visualizing the latent image, the improvement wherein said resilient sleeve is made of a urethane elastomer containing carbon black, and said carbon black has a pH of at least 5; and, wherein, said latent image bearing member is a rotating roller-shaped member.

15. An image forming apparatus comprising:

a latent image bearing member and a developing roller; wherein, in said developing roller comprising a highly conductive shaft and a conductive resilient sleeve surrounding the shaft, said developing roller carrying a non-magnetic single-component developer on the surface of said conductive resilient sleeve to form a thin layer of the developer and being contacted with said latent image bearing member having an electrostatic latent image borne on the surface thereof, whereby said developer is transferred from said thin layer to said electrostatic latent image on the image bearing member surface for visualizing the latent image, the improvement wherein said resilient sleeve is made of a urethane elastomer containing carbon black, and said carbon black has a pH of at least 5; and, wherein, said latent image bearing member is a drum-shaped member.

16. An image forming apparatus as in claim 14, wherein said urethane elastomer has a resistivity of $10^4$ to $10^{10}$ Ωcm, a hardness of up to 55° on JIS A scale, and a surface roughness Rz of up to 10 μm as expressed in JIS ten point average roughness.

17. An image forming apparatus as in claim 15, wherein said urethane elastomer has a resistivity of $10^4$ to $10^{10}$ Ωcm, a hardness of up to 55° on JIS A scale, and a surface roughness Rz of up to 10 μm as expressed in JIS ten point average roughness.

18. An image forming apparatus as in claim 14, wherein said urethane elastomer further contains silicone powder.

19. An image forming apparatus as in claim 15, wherein said urethane elastomer further contains silicone powder.

* * * * *